US010526161B2

(12) United States Patent
Banda

(10) Patent No.: US 10,526,161 B2
(45) Date of Patent: Jan. 7, 2020

(54) WIRE SPOOL GUIDE

(71) Applicant: Evan Banda, Beaumont, CA (US)

(72) Inventor: Evan Banda, Beaumont, CA (US)

( * ) Notice: Subject to any disclaimer, the term of this patent is extended or adjusted under 35 U.S.C. 154(b) by 0 days.

(21) Appl. No.: 16/025,810

(22) Filed: Jul. 2, 2018

(65) Prior Publication Data

US 2019/0002231 A1 Jan. 3, 2019

Related U.S. Application Data

(60) Provisional application No. 62/527,923, filed on Jun. 30, 2017.

(51) Int. Cl.

| | |
|---|---|
| ***B65H 57/08*** | (2006.01) |
| ***B65H 57/18*** | (2006.01) |
| ***B65H 57/10*** | (2006.01) |
| ***B65H 57/26*** | (2006.01) |

(52) U.S. Cl.

CPC ..... *B65H 57/08* (2013.01); *B65H 57/10* (2013.01); *B65H 57/18* (2013.01); *B65H 57/26* (2013.01)

(58) Field of Classification Search

CPC ..... B65H 57/08; B65H 57/10; B65H 57/26; B65H 57/18

See application file for complete search history.

(56) References Cited

U.S. PATENT DOCUMENTS

| | | | | | |
|---|---|---|---|---|---|
| 336,704 | A * | 2/1886 | Delanoy, Jr. | B60R 22/34 | 242/377 |
| 444,866 | A * | 1/1891 | Werner | A01K 97/26 | 242/129.53 |
| 777,926 | A * | 12/1904 | Stevens | B65H 75/406 | 242/396.4 |
| 816,328 | A * | 3/1906 | Holt | B65H 75/406 | 242/396.1 |
| 1,022,077 | A * | 4/1912 | Haas | B65H 49/32 | 242/129.62 |
| 1,079,896 | A * | 11/1913 | Yorger | B65H 49/32 | 242/129.62 |
| 1,470,886 | A * | 10/1923 | Sherwin | B65H 75/406 | 242/396.1 |
| 1,960,273 | A * | 5/1934 | May | D05B 91/14 | 242/129.53 |
| 7,195,193 | B2 * | 3/2007 | Capps | E04H 17/266 | 242/396.5 |

(Continued)

*Primary Examiner* — William A. Rivera

(74) *Attorney, Agent, or Firm* — Jafari Law Group, Inc.

(57) ABSTRACT

The invention involves an improved wire spool guide including a frame that comprises adjacent legs for coupling with a support rod that typically traverses the center of a wire spool hub. Each leg includes a terminal end comprising a spring arm and rod-registering area configured to capture a portion of the rod while allowing the rod to rotate therein. In exemplary embodiments, each leg extends from an anterior support of the frame that is roughly perpendicular to both legs. A wire-guiding element extends substantially form a center portion of the anterior support. The wire-guiding element may be defined by a helical structure configured for allowing a portion of the wire to be weaved into the helical structure rather than having to be threaded through. The helical structure may include an incongruous element, which prevents the wire from tangling at an exit point of the wire-guiding element.

18 Claims, 9 Drawing Sheets

(56) References Cited

U.S. PATENT DOCUMENTS

| | | | | |
|---|---|---|---|---|
| 2002/0117574 | A1* | 8/2002 | Hawley | B65H 57/00 242/422.8 |
| 2011/0024547 | A1* | 2/2011 | Parks | B65H 57/08 242/615.3 |

* cited by examiner

WIRE SPOOL GUIDE

PRIORITY NOTICE

The present application claims priority under 35 U.S.C. § 119(e) to U.S. Provisional Patent Application Ser. No. 62/527,923 filed on Jun. 30, 2017, the disclosure of which is incorporated herein by reference in its entirety.

TECHNICAL FIELD OF THE INVENTION

The present invention relates generally to an improved wire spool guide. More specifically, the present invention relates to a wire spool guide including structural elements configured for removably coupling to a wire spool and guiding wire from the spool in a manner that reduces inherent tangling or snagging.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Wire spool guides and their use is well known and commonly disclosed in the prior art. Moreover, this crowded art offers various shapes and sizes for addressing widely different objectives.

Some of these prior art devices have designs comprising guides that assist users with dispensing threads, conduits, wires, twine or other similarly spooled materials. Generally, these known devices implement wire-guiding elements or structures that require users to thread the spooled material through some tubular structure (for example such as an eye bolt) or similar single-opening structure that is circumferentially or perimetrically closed around the opening; as will be explained further below, this approach is inefficient and unnecessarily time consuming.

Some devices have features and characteristics that include moving components designed to attach to a spool and or adjust elements of the spool guide; these devices, however, are difficult to detach and reattach to other spools, thus limiting the versatility of the devices.

Yet other devices include entire assemblies for providing guides to numerous spools stored in such assemblies; again, making their use with various applications (i.e. varying types of spools) cumbersome, or simply impossible.

Examples of known wire spool guides include U.S. Pat. No. 5,516,059 to Gudgeon et al., which discloses a wire guide to control and contain electrical wire as it is pulled off a standard spool that is rotating about a spindle. The guide has side plates that rest alongside the spool. Adjustable length guide bars extend between the side plates with the wire passing between the guide bars to guide the wire. However, one problem with this device is that the wire is not easily kept in a center portion of the guide so as to fully protect the wire from becoming untangled or snagged by commonly damaged spool hubs. Another problem with this device is that it is cumbersome to attach or couple to a spool; that is, it requires some assembly to attach to a spool—which is of course undesirably time-consuming. Similarly, detaching the device from the spool is unnecessarily cumbersome. Moreover, the guide mechanism is limited in that it requires threading and does not necessarily keep the spooled material at a centered position, which gives rise to other problems including tangling the spooled material with often broken spool flanges.

Another example of known wire spool guides includes U.S. Pat. No. 7,124,980 to Giovannoni, which discloses a wire spool assembly. That wire spool guide assembly comprises a conduit through which wire is dispensed. The assembly has at least one wire spool guide, a handle bar and a spindle. The spindle is typically part of a wire spool cart. The guide includes an eyebolt rotatably mounted to a support frame via a ball bearing. The eye bolt guides wire as it is dispensed from the spool. This device has a similar problem as other spool guides, which require the spooled material (i.e. wire, thread, twine, etc.) to be threaded through the eye bolt or wire guide element. As mentioned above, this required motion can be unduly burdensome and time consuming on the field. Furthermore, this device is typically included with a cart, meaning that use of the device is limited to spools situated on that cart. Moreover, the coupling mechanism requires assembly, which means that switching the guide from one spool to another spool (not situated on the same cart, for example) requires that device to be disassembled and reassembled prior to each use.

Another example of known wire guides includes U.S. Patent Publication 2006/0006276 to Wyatt, which discloses hanging and distributing both spooled and non-spooled products. This device has several drawbacks, one of such drawbacks being that this device too requires the spooled material to be threaded through the guide.

Other examples include U.S. Pat. Nos. D739717, D739718, D739719, D740644, and D741154 to Brown, which disclose ornamental designs for various wire spool guides. Other known examples for similar guides (although used with other materials such as threads, yarns and twine) include: U.S. Pat. No. 95,271 to Schrader; U.S. Pat. No. 316,595 to Adams; and U.S. Pat. No. 444,866 to Werner. All of these device designs carry one or more of the problems outlined above.

Known devices, such as those briefly described above, offer different alternatives at guiding a spooled material such as wires, threads, or twines, but each has one or more shortcomings. For example: all of these known devices require the wire or spooled material to be threaded through a single opening that is circumferentially or perimetrically closed; each of these devices is cumbersome to attach or couple to a spool, and difficult or impossible to detach and reattach to varied sizes of spools; and the guide structures do not necessarily keep material from falling off the edges of the spool, or prevent the material from getting snagged when broken spool edges present snag-points. Moreover, the more complex, cumbersome prior art devices typically comprise several parts and components, making them less efficient and costlier to manufacture.

Therefore, there exists a previously unappreciated or inadequately-met need for a new and improved wire spool guide that: allows a user to easily weave a spooled material into a wire-guiding element without requiring the material to be threaded; implements a coupling mechanism that allows for quick and efficient implementation with varying sized spools; is configured or constructed in such a way that obviates problems often caused by damaged spool hub edges; and may be manufactured efficiently and in an inexpensive manner. It is to these ends that the present invention has been developed.

SUMMARY OF THE INVENTION

To minimize the limitations in the prior art, and to minimize other limitations that will be apparent upon reading and understanding the present specification, the present invention describes a wire spool guide with an improved design suitable for removably coupling to a wire spool and guiding wire from the spool in a manner that reduces inherent tangling or snagging.

Generally, the invention involves a wire spool guide including structural elements configured for coupling to a wire spool and guiding wire from the spool. Typically, a wire spool guide in accordance with the present invention comprises a frame that includes adjacent legs for coupling with a support rod that traverses the center of a wire spool hub. Each leg includes a terminal end comprising a spring arm and rod-registering area that is shaped to capture a portion of the rod while allowing the rod to rotate therein. In exemplary embodiments, each leg extends from an anterior support of the frame that is roughly perpendicular to both legs—although as will be explained below, each leg preferably extends at a slight angle towards a common center to create desirable friction points only at each leg's terminal end.

From a center portion of the anterior support, a wire-guiding element extends to form a tubular structure that is circumferentially opened, suitable for receiving a portion of the wire from the spool without requiring a user to thread the wire through a single opening. The tubular structure may be defined by a helical rod configured for allowing a portion of the wire to be weaved into the center space within the helical rod rather than having to be threaded through. In exemplary embodiments, the helical rod includes an incongruous element at a terminal end, which prevents the wire from tangling at an exit point of the wire-guiding element.

Accordingly, a wire spool guide in accordance with one exemplary embodiment of the present invention, comprises: a frame including an anterior support; a prong defined by a first leg and a second leg extending from the anterior support, the first leg and the second leg having a coupling means for coupling to a spool; and a wire-guiding element extending substantially from a center portion of the anterior support, the wire-guiding element comprising a helical structure.

In some exemplary embodiments, a wire spool guide may be formed of a single rod having two terminal ends. In such embodiments, a wire spool guide may comprise: a first prong configured to receive a wire spool, the first prong defined by a first leg extending from a first end of a midsection of the rod and, a second leg extending from a second end of the midsection of the rod, the first leg and the second leg situated on a first plane; a second prong configured to couple to a support of the wire spool, the second prong defined by the first leg and a third leg extending from a first u-shaped bend on the rod, the first leg and the third leg situated on a second plane; a third prong configured to couple to the support of the spool, the third prong defined by the second leg and a fourth leg extending from a second u-shaped bend on the rod, the second leg and the fourth leg situated on a third plane; and a helical structure adapted to receive a portion of a wire from the wire spool, the helical structure extending from the midsection of the rod, wherein: the third leg terminates at a first terminal end of the rod, the fourth leg terminates at a second terminal end of the rod, and the second plane is parallel with the third plane, the second plane and the third plane intersecting the first plane.

In some exemplary embodiments, a wire spool guide may similarly comprise: a first prong configured to receive a wire spool, the first prong defined by a first leg extending from a first end of a midsection of a frame, and a second leg extending from a second end of the midsection of the frame, the first leg and the second leg situated on a first plane; a second prong configured to couple to a support of the wire spool, the second prong defined by the first leg and a third leg joined by a first u-shaped bend on the frame, the first leg and the third leg situated on a second plane; a third prong configured to couple to the support of the wire spool, the third prong defined by the second leg and a fourth leg joined by a second u-shaped bend on the frame, the second leg and the fourth leg situated on a third plane, wherein the second plane and the third plane intersecting the first plane; and a helical structure adapted to receive a portion of a wire from the wire spool, the helical structure extending from the midsection of the frame.

Furthermore, a wire spool guide assembly in accordance with one exemplary embodiment of the present invention, comprises: a spool of wire coupled to a support rod that traverses a spool hub of the spool; and a wire spool guide removably coupled to the support, the wire spool guide comprising: a frame including an anterior support; a prong defined by a first leg and a second leg extending from the anterior support, the first leg and the second leg having a coupling means for coupling to the support rod; and a wire-guiding element extending substantially from a center portion of the anterior support, the wire-guiding element comprising a helical structure configured to receive a portion of wire from the spool.

It is an objective of the present invention to provide an improved wire spool guide that allows a user to easily weave a spooled material into a guiding element without requiring the material to be threaded through a single opening.

It is another objective of the present invention to provide an improved wire spool guide that implements a coupling mechanism that allows for quick and efficient implementation with varying sized spools.

It is yet another objective of the present invention to provide an improved wire spool guide that is configured or constructed in such a way that obviates problems often caused by damaged spool hub edges.

It is yet another objective of the present invention to provide a wire spool guide that may be manufactured efficiently and inexpensively.

These advantages and features of the present invention are not meant as limiting objectives, but are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of the various embodiments of the invention. Furthermore, elements that are known to be common, and well understood to those in the industry, are not necessarily depicted in order to provide a clear view of the various embodiments of the invention.

The drawings that accompany the detailed description can be briefly described as follows:

FIG. 1(*b*) illustrates a perspective view of the wire spool guide depicted in FIG. 1(*a*).

FIG. 2(*b*) illustrates a back view of the wire spool guide depicted in FIG. 2(*a*).

FIG. 3(*b*) illustrates a side view of the wire spool guide depicted in FIG. 2(*a*).

FIG. 3(*c*) illustrates a side plan view of a wire spool guide assembly in accordance with the present invention, depicting various possible trajectories of wire guided from a central control structure at the front of the apparatus.

FIG. 4(*b*) illustrates a bottom view of the wire spool guide depicted in FIG. 2(*a*), and further depicting an area representative of a spool coupled to the wire spool guide shown.

FIG. 4(*c*) illustrates an exemplary embodiment of the wire spool guide depicted in FIG. 4(*a*).

FIG. 4(*d*) illustrates an exemplary embodiment of the wire spool guide depicted in FIG. 4(*a*), which includes a frictional element.

FIG. 4(*e*) illustrates an exemplary embodiment of the wire spool guide depicted in FIG. 4(*a*), which includes a telescoping element to adjust a length of a support structure of a frame of the wire spool guide.

FIG. 4(*f*) illustrates another exemplary embodiment that includes longer friction points for improved stability.

DETAILED DESCRIPTION OF THE INVENTION

Figure 1A:
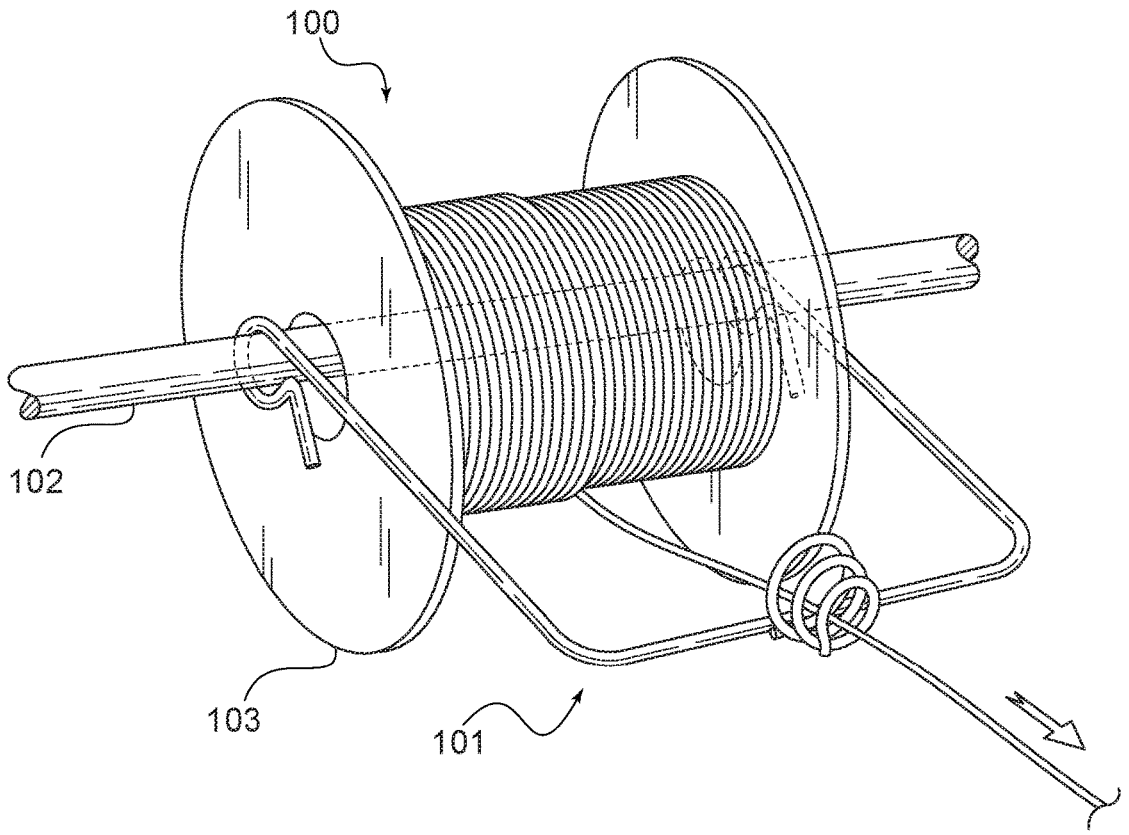
FIG. 1(*a*) illustrates a perspective view of a wire spool guide assembly in accordance with one exemplary embodiment of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

The present disclosure relates to, among other things, a wire spool guide. Exemplary embodiments of the present disclosure are described with reference to the drawings for illustration purposes and are not intended to limit the scope of the present disclosure.

Figure 1B:
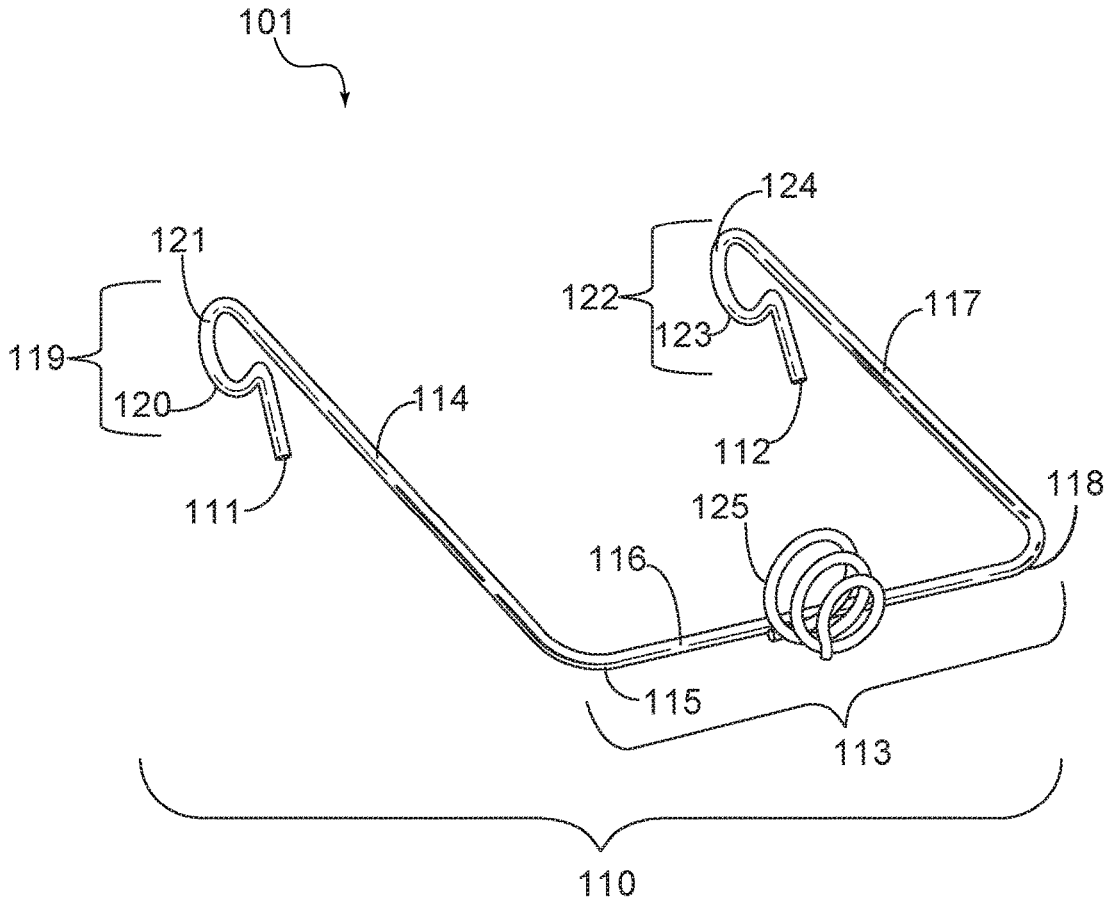

Turning now to the figures, FIG. 1(*a*) illustrates a perspective view of a wire spool guide assembly in accordance with one exemplary embodiment of the present invention. More specifically, FIG. 1(*a*) illustrates wire spool guide assembly (assembly 100) including a wire spool guide (guide 101), which has been coupled to a spool rod 102 on which spool 103 spins about or rotates during the pulling of the wire from the spool.

FIG. 1(*b*) illustrates a perspective view of the wire spool guide depicted in FIG. 1(*a*). As may be appreciated from this view, a wire spool guide in accordance with the present invention, comprises a frame (e.g. made of a single rod 110) including an anterior support (or midsection 116), wherein the frame is defined by a prong further defined by a first leg and a second leg extending from the anterior support, the first leg and the second leg having a coupling means for coupling to a spool, and more specifically to a spool rod coupled to a spool. Importantly, a wire-guiding element (or helical structure 125) extends substantially from a center portion of the anterior support of the frame. Moreover, as will be further discussed below, the wire-guiding element typically comprises a helical structure that may be formed by implementation of a helical rod (e.g. helical structure 125).

In exemplary embodiments, the main frame's body connects the legs (including hooks or attachment points) to each other at terminal ends of each leg. The anterior support typically extends laterally a respective distance that spans at least the width of the spool. The helical structure is typically connected to the anterior support, although in some embodiments, the helical structure may be formed or extend unitarily from the anterior support structure itself (see brief discussion with reference to FIG. 4(*c*) below).

Prior to using (or assembling) assembly 100, a user may quickly couple guide 101 to spool rod 102 by hooking each of the frame's legs onto a portion of the spool rod 102, having spool 103 within the prong of the frame and in-between each of the frame's legs.

During use of assembly 100, The user may typically take a portion of the wire and weave it through the openings of the helical structure, rather than having to thread it through an eye-bolt or similar structure that is circumferentially or perimetrically closed around a single opening.

To be clear, for purposes of this application, the term "threading" refers generally passing a thread, wire, twine, or otherwise a spooled material through an opening (such as an eyebolt or tubular structure like the eye of a needle) wherein the opening is circumferentially or perimetrically closed.

The term "weaving" refers generally to interlacing or inserting a thread, wire, twine, or otherwise a spooled material through an opening that is circumferentially or perimetrically open—such as a helical structure.

In some exemplary embodiments, wire spool guide 101 may be formed of a single frame made of a single rod 110 having two terminal ends 111 and 112. The frame or rod 110 may include a first prong 113 configured to receive a wire spool in between two legs of the prong, wherein the first prong 113 is defined by a first leg 114 extending from a first end 115 of an anterior support or midsection 116 of the rod 110 and, a second leg 117 extending from a second end 118 of the midsection 116 of the rod 110, the first leg 114 and the second leg 117 situated on a single plane.

Moreover, the frame of wire spool guide 101 may include a second prong 119 configured to couple to a support or spool rod 102 of the wire spool 103, the second prong 119 defined by the first leg 114 and a third leg 120 extending from a first u-shaped bend 121 on the rod 110, the first leg 114 and the third leg 120 situated on a second plane that intersects the first plane shared by the first and second legs 114, 117.

Moreover, the frame of wire spool guide 101 may include a third prong 122 configured to couple to the spool rod 102 of the spool 103, the third prong 122 defined by the second leg 117 and a fourth leg 123 extending from a second u-shaped bend 124 on the rod 110, the second leg 117 and the fourth leg 123 situated on a third plane that intersects the first plane shared by the first and second legs 114, 117.

Moreover, the frame of wire spool guide 101 typically includes a helical structure 125 adapted to receive a portion of a wire from the wire spool 103 (for example as shown in FIG. 1(*a*)), the helical structure 125 extending from the midsection of the rod 110.

As mentioned above, in some exemplary embodiments the frame is made of a single rod wherein the third leg 120 terminates at the first terminal end 111 of the rod 110, the fourth leg 123 terminates at the second terminal end 112 of the rod 110. In some exemplary embodiments, the second plane is parallel with the third plane, however as will be discussed further below, in some exemplary embodiments, legs 114 and 117 taper towards a center region of the frame.

In some exemplary embodiments, the frame may include more than one component such as more than one rod or may be even formed using a mold. Accordingly, in some embodiments, a wire spool guide may comprise a first prong configured to receive a wire spool, the first prong defined by a first leg extending from a first end of a midsection of a frame, and a second leg extending from a second end of the midsection of the frame, the first leg and the second leg situated on a first plane; a second prong configured to couple to a support of the wire spool, the second prong defined by the first leg and a third leg joined by a first u-shaped bend on the frame, the first leg and the third leg situated on a second plane; a third prong configured to couple to the support of the wire spool, the third prong defined by the second leg and a fourth leg joined by a second u-shaped bend on the frame, the second leg and the fourth leg situated on a third plane, wherein the second plane and the third plane intersecting the first plane; and a helical structure adapted to receive a portion of a wire from the wire spool, the helical structure extending from the midsection of the frame.

Figure 2A:
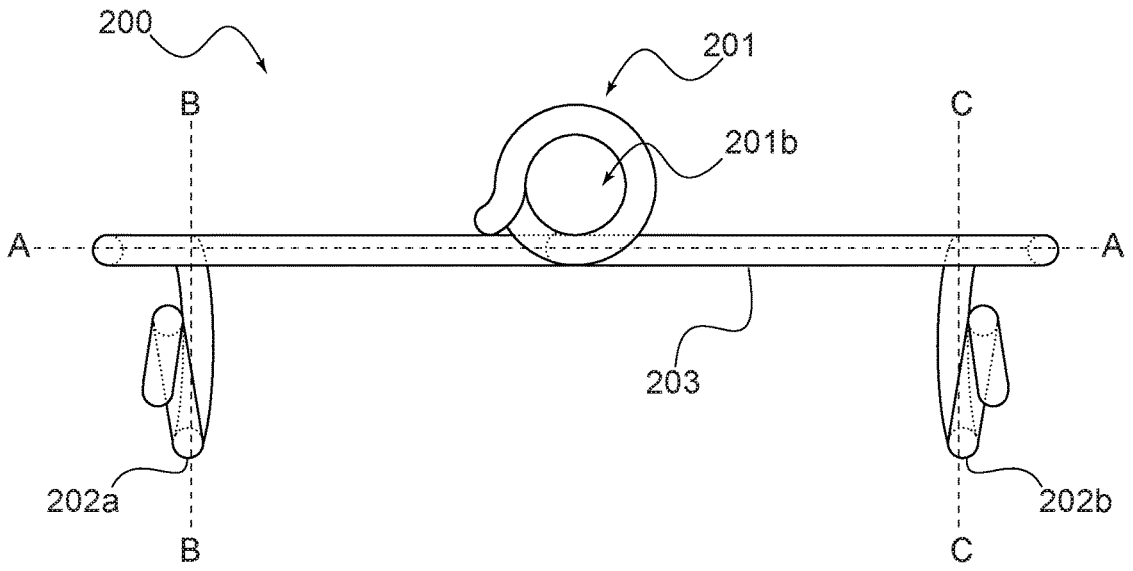
FIG. 2(*a*) illustrates a front view of a wire spool guide in accordance with one exemplary embodiment of the present invention.
Figure 2B:
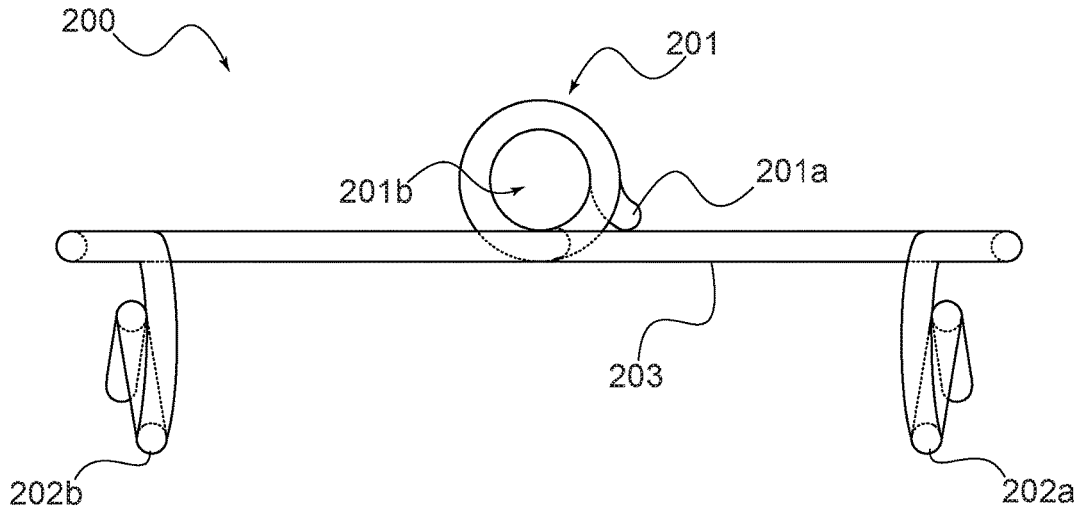

Turning now to the next figure, FIG. 2(*a*) illustrates a front view of a wire spool guide in accordance with one exemplary embodiment of the present invention. More specifically, FIG. 2(*a*) depicts a front view of spool guide 200 illustrating a helical rod 201 extending or protruding from a center portion of the midsection of the frame or anterior support 203. Also extending from anterior support 203, but towards a posterior end of spool guide 200, are legs 202*a* and 202*b*, which as will be discussed below with reference to other figures, form coupling components for coupling or attaching to a spool rod.

In exemplary embodiments, helical rod 201 comprises of multiple helical loops extending forward from anterior support 203 and ending at an incongruous terminal end that slightly edges outward and away from a center space along the axis. In exemplary embodiments, the helical rod forms a cylindrical helix. However, other shapes may be implemented without deviating from the scope of the present invention, such as a spiral helix, a screw-type helix, etc.

Helical rod 201 may be connected to anterior support 203 of guide 200 at a first terminal end of the helical structure. As may be appreciated from the figures, helical rod 201 is not typically attached to any component at the opposite or second terminal end of the helical structure. Accordingly, helical rod 201 comprises a helical structure including a tubular or cylindrical opening 201*b* along the axis of the helical rod 201 with the first terminal end terminating at the anterior support 203, and the second terminal end terminating at an incongruous terminal end 201*a*.

From the front view depicted by FIG. 2(*a*), as well as the back view shown in FIG. 2(*b*), it may be appreciated that the incongruous terminal end 201*b* veers outward and away from the common curvature of the helical structure so that it juts out of a general circumference of helical rod 201. FIG. 2(*b*) illustrates the back view of the wire spool guide depicted in FIG. 2(*a*). This incongruous alteration of the helical structure aids in resisting tangling from wire at this point in helical rod 201. Moreover, the incongruous terminal end 201*a* provides a change in rotational direction of the helical structure, which aids in resisting tangling of a wire portion within the helical structure by allowing room to be recaptured when the wire is dispensed at obtuse angles.

Figure 3A:
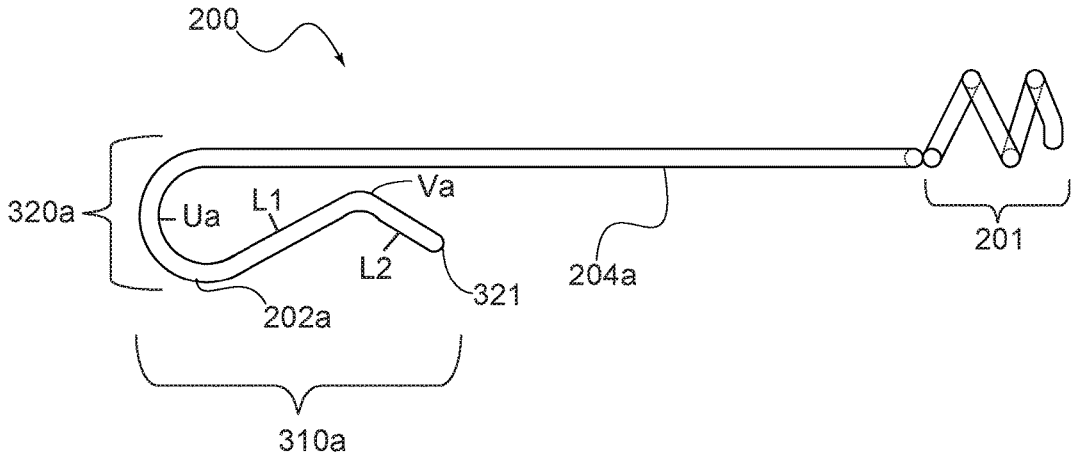
FIG. 3(*a*) illustrates a side view of the wire spool guide depicted in FIG. 2(*a*).
Figure 3B:
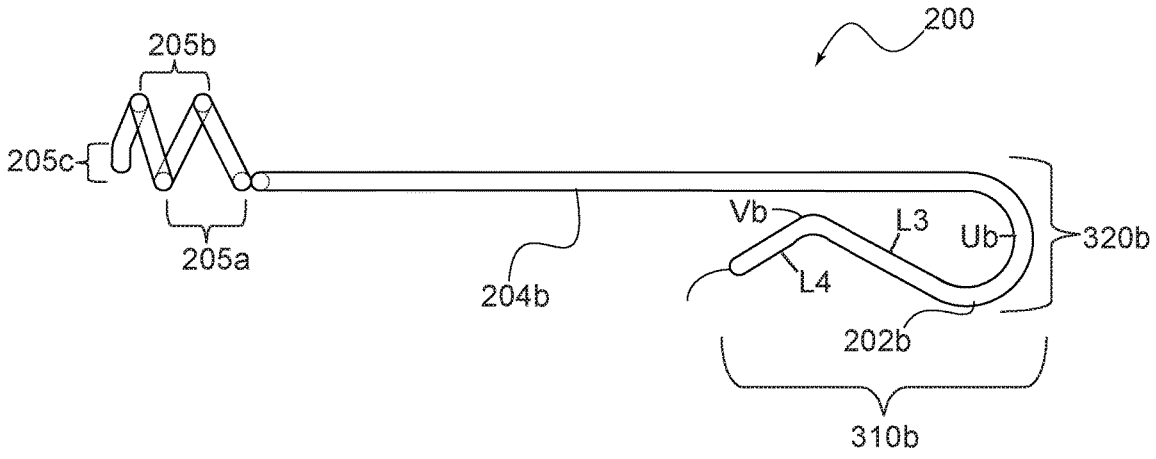
Figure 3C:
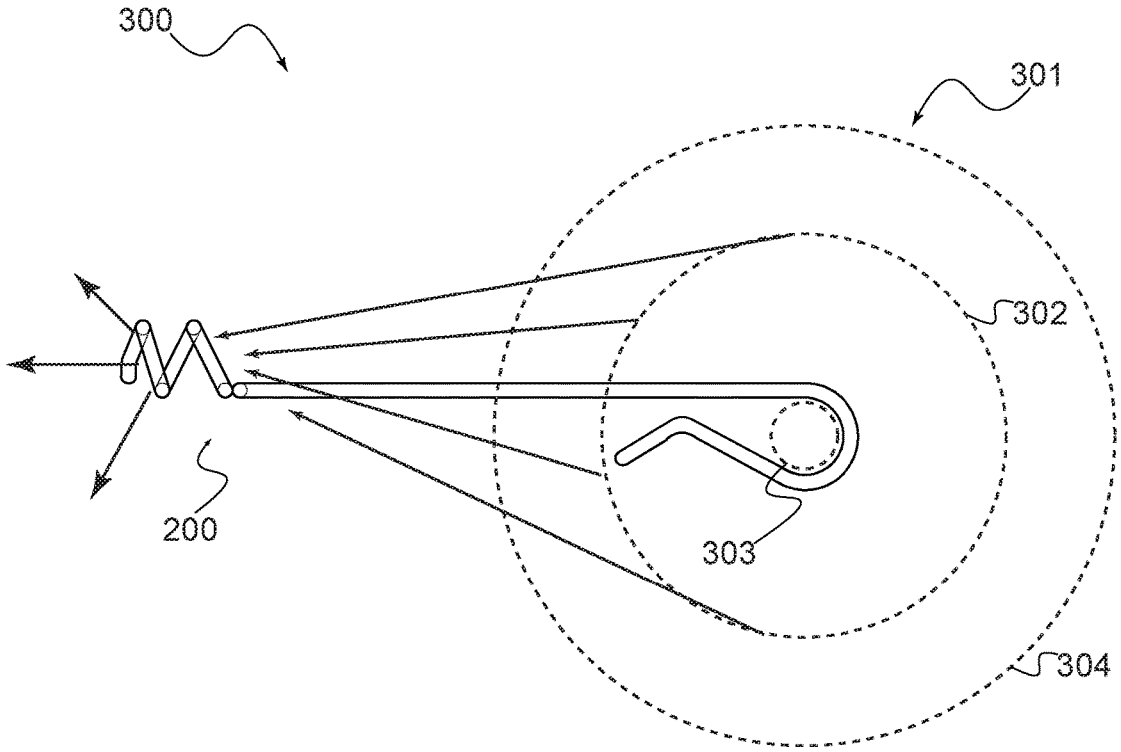
Figure 4A:
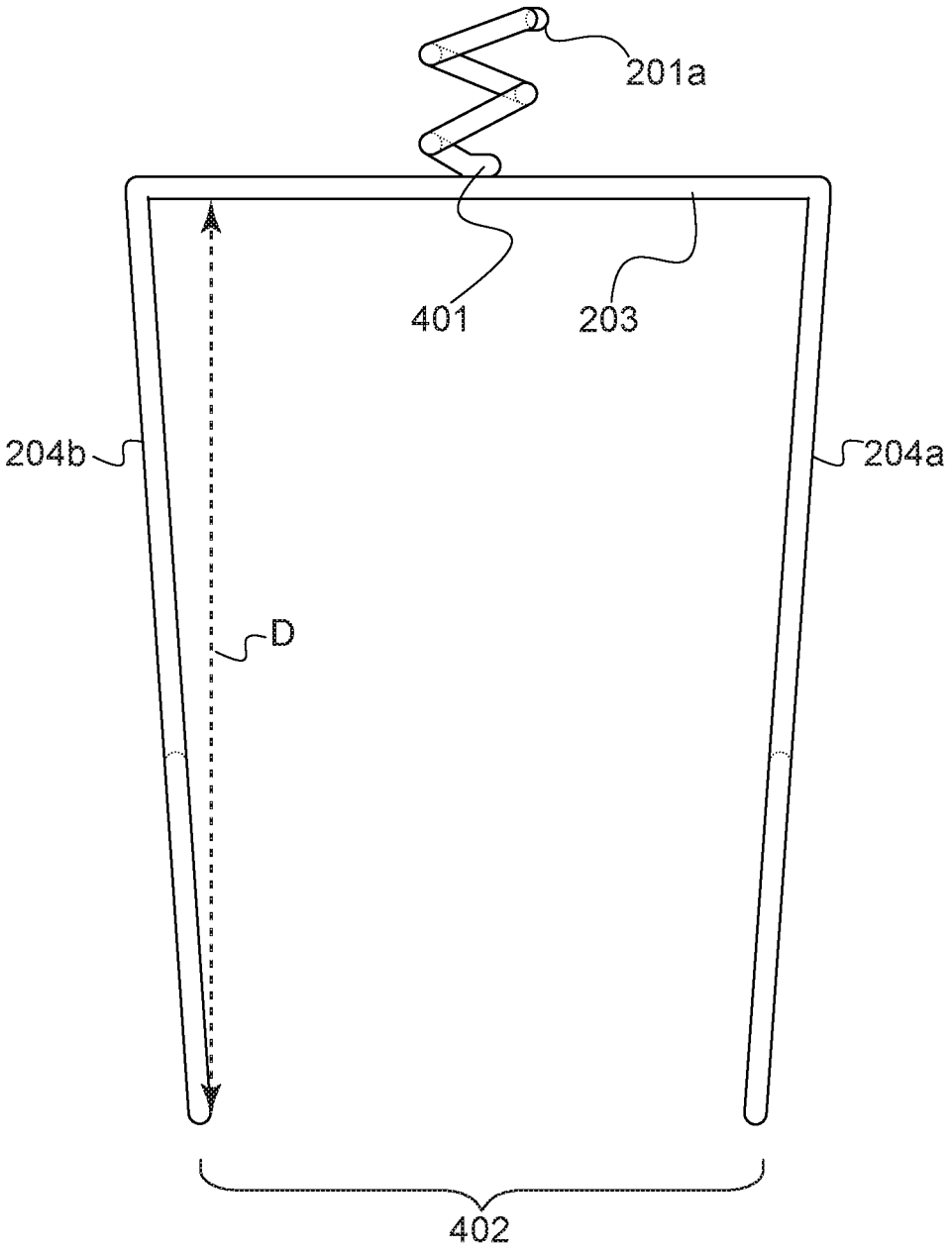
FIG. 4(*a*) illustrates a top view of the wire spool guide depicted in FIG. 2(*a*).
Figure 4B:
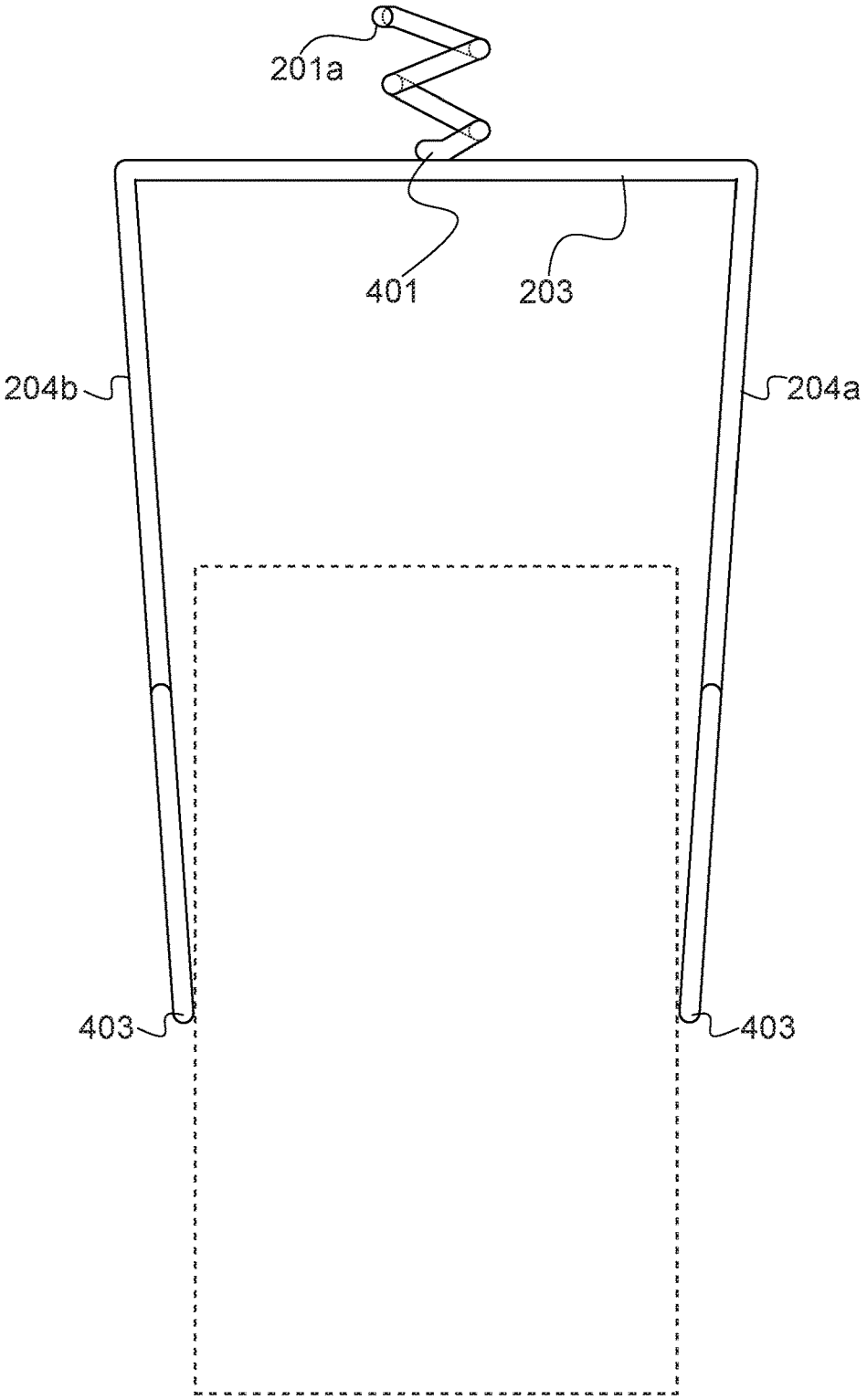
Figure 4C:
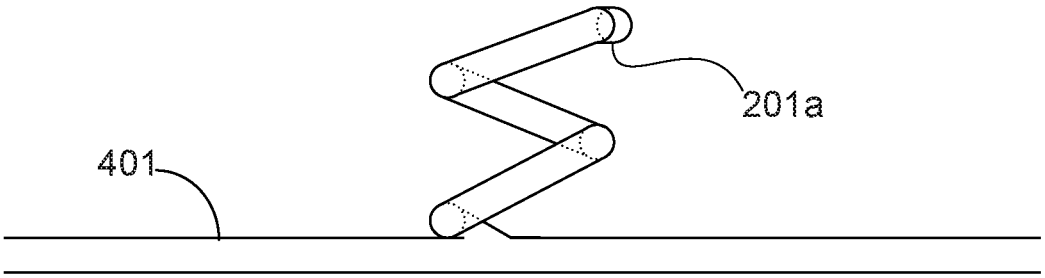
Figure 4D:
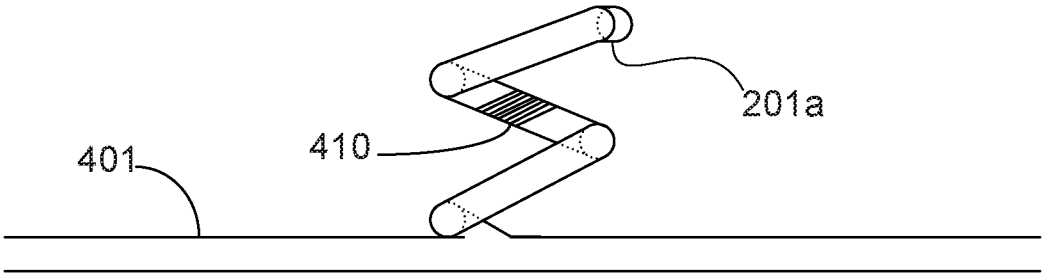
Figure 4E:
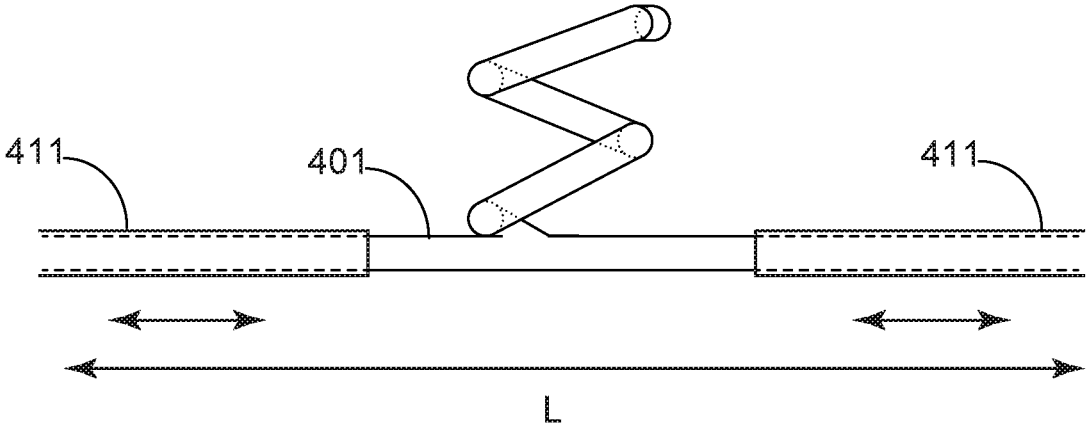
Figure 4F:
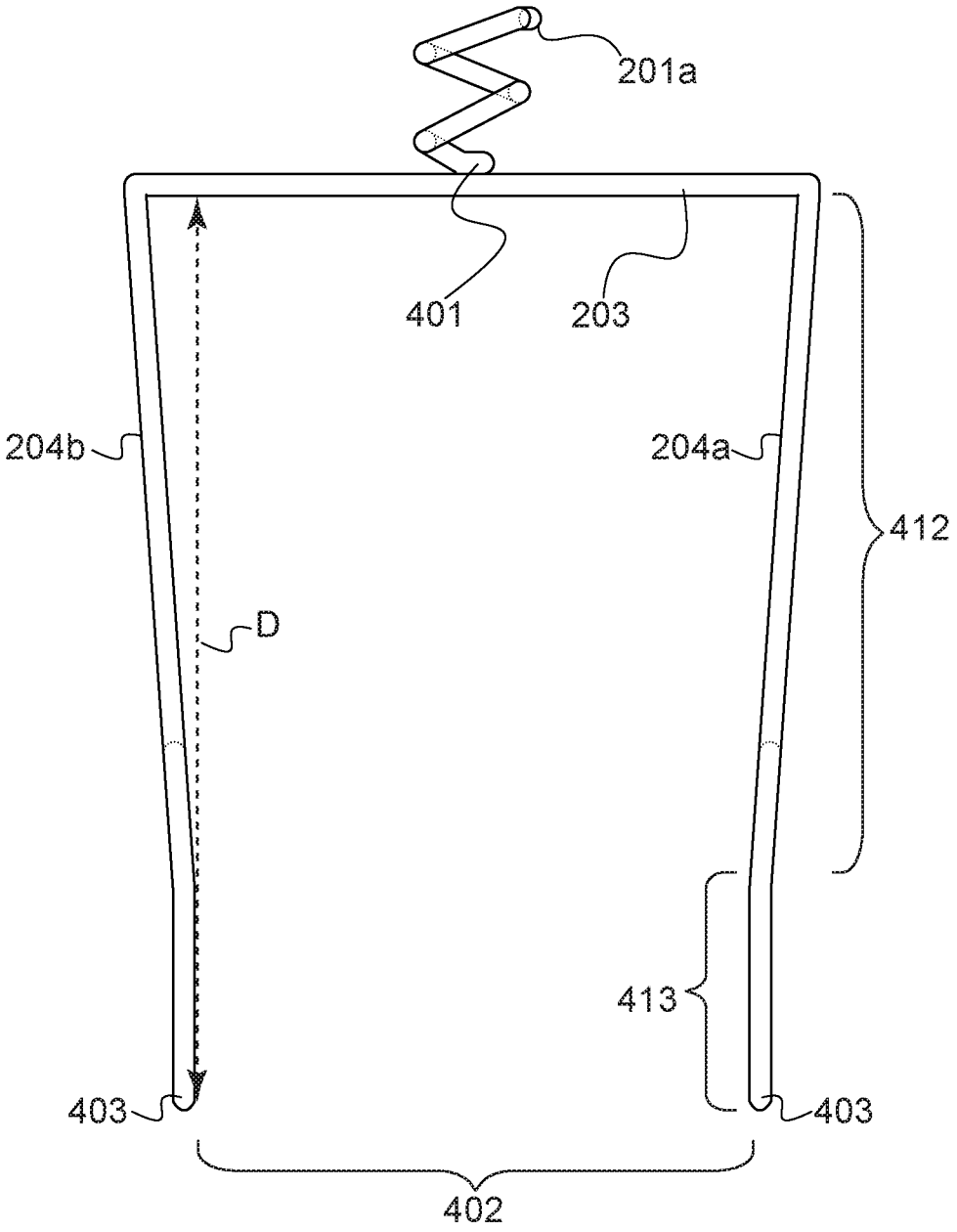

Turning now to the next figures, several side views are presented: FIG. 3(*a*) illustrates a side view of the wire spool guide depicted in previous figures; FIG. 3(*b*) illustrates a second side view of the wire spool guide depicted in FIG. 3(*a*); and FIG. 3(*c*) illustrates a side plan view of a wire spool guide assembly in accordance with the present invention, depicting various possible trajectories of wire guided from a central control structure or wire-guiding element at the front of the apparatus.

As may be appreciated from these side views, in the illustrated exemplary embodiment, helical rod 201 includes lateral supports or legs 204*a* and 204*b* that extend from opposite sides of anterior support 203. Furthermore, each leg 204*a* and 204*b* may comprise of a coupling means such as hooks or a device that may fasten or be fastened, or any a device, typically flexible or worked by a spring, for holding an object or objects together or in place. In an exemplary embodiment, guide 200's legs 202*a*, 204*a* form prongs 320*a* and legs 202*b* and 204*b* form prong 320*b*. Each prong may form a clip (310*a* and 310*b*, respectively) that registers with a spool rod in a manner such that guide 200 is able to rotate on the same axis as the spool; this allows the wire-guiding element to pivot at an angle matching the direction in which a wire portion is being pulled. For example, and without deviating from the scope of the present invention, a user may pull wire through the wire-guiding element in a horizontal direction, an upward direction, or a downward direction, and the guiding element will rotate or pivot in the direction the wire is being pulled.

Each clip 310*a* and 310*b* may be defined by a portion of its corresponding leg, a u-shaped bend extending from a terminal end of the corresponding leg, and a smaller bent leg that extends from an opposite end of the u-shaped bend and is situated on the same plane. A portion of the smaller bent leg approaches, but does not make contact with the corresponding leg, and bends away at a bent portion from the corresponding leg creating a gap between the bent portion and the corresponding leg. The gap is typically smaller than the space situated within the u-shaped bend, which ultimately is configured to register with the spool rod. In exemplary embodiments, this smaller gap may be greater than 50% of the largest spool rod designed to be captured by guide 200, so as to allow the spring arm to bend over the spool rod when coupling guide 200 to a spool.

Specifically, with reference to FIG. 3(*a*), in such exemplary embodiments the clip 310*a* may be defined by a first length L1 that may extend from a u-shaped bend Ua towards the leg 204*a* of the prong 320*a*, the first length L1 terminating at a sharp bend Va, and a second length L2 that extends from the sharp bend Va away from the leg 204*a*, wherein the second length L2 terminates at the a first terminal end 321 of the rod or frame.

In exemplary embodiments, the clips on each side prong are identical and as such structured the same. Accordingly, with reference to FIG. 3(*b*), in such exemplary embodiments the clip 310*b* may be defined by a first length L3 that may extend from a u-shaped bend Ub towards the leg 204*b* of the prong 320*b*, the first length L3 terminating at a sharp bend Vb, and a second length L4 that extends from the sharp bend Vb away from the leg 204*a*, wherein the second length L4 terminates at the a second terminal end 322 of the rod or frame.

As may be further appreciated from these side views, in the illustrated exemplary embodiment, helical rod 201 may be defined by approximately 2.5 curves extending from anterior support 203. For example, and without limiting the scope of the present invention, helical rod 201 may have a conventional spring appearance. Of course, in other embodiments, helical rod 201 may include less or more curves or loops without deviating from the scope of the present invention.

Focusing particularly on FIG. 3(*b*), it may be noted that the helical structure of helical rod 201 may not necessarily comprise equidistant curves or loops such as a typical cylindrical helix. In fact, in exemplary embodiments it may be desirable to implement a varied spacing so that the curves or loops forming the helical structure are not equidistant. For example, and without limiting the scope of the present invention, a first spacing 205*a* may comprise a larger or wider spacing than a second spacing 205*b* between one or more of the curves of the helical structure. This change in spacing between curves of the helical structure may allow for respective wire ranges to bend as required. Moreover, the change in spacing allows for easy placement of a wire portion within the helical structure (since a first spacing 205*a* is generally wider), but once the wire portion is weaved inside opening 201*b* along an axis of the helical structure, the narrower second spacing 205*b* provides enough support so that the wire does not easily fall out of the wire-guiding element of guide 200.

Momentarily referencing back to FIG. 2(*a*), it may be appreciated that while legs 204*a* and 204*b* extend along a single plane A to form a first or primary prong that holds the wire spool, legs 204*a* and 202*a* extend along a single plane B to form a second prong 320*a* and legs 204*b* and 202*b* extend along a single plane C to form a third prong 320*b*, wherein, in some embodiments, planes B and C are parallel; however in other embodiments, planes B and C are not parallel but nevertheless intersect with plane A.

Turning now to the next side view, FIG. 3(*c*) illustrates a side plan view of a wire spool guide assembly in accordance with the present invention, depicting various possible trajectories of wire guided from a central control structure at the front of the apparatus. More specifically, FIG. 3(*c*) depicts assembly 300, which comprises of guide 200 coupled to spool hub 301 via spool rod 303, on which spooled hub 301 rotates as the wire of the spool is pulled off or dispensed. The trajectory (shown by directional arrows) may depend on a number of factors such as the quantity of spooled wire (302) left in the spool hub, as well as the direction in which the wire is pulled from the spool via the wire-guiding element of guide 200.

Turning now to the next figure, FIG. 4(*a*) illustrates a top view of the wire spool guide 200. More specifically, this view depicts a top view of incongruous terminal end 201*a*, anterior support 203 (as well as each of the legs extending therefrom), an attachment point 401 on anterior support 203 from which the wire-guiding element extends, and a space or distance 402 between prongs 320*a* and 320*b* at the posterior end of the spool guide 200.

Although in this embodiment the helical structure of the wire-guiding element of guide 200 is attached to a front part of anterior support 203, in alternative embodiments, other attachment configurations may be implemented without deviating from the scope of the present invention. Moreover, in some alternative embodiments, the wire-guiding element's helical structure, the anterior support and legs may all be constructed unitarily using injection mold methods or the like. From this top view, it may be appreciated that a space between the legs of the frame of guide 200 may taper or narrow as the leg stretches from the anterior support towards the posterior terminal ends where the clips are situated. For example, and without limiting the scope of the present invention, distance 402 may have a shorter length than the length of anterior support 203. In exemplary embodiments, this angled positioning of each leg creates a clearance area between the leg and line D to allow for broken spool flanges that may otherwise get caught by a portion of wire being pulled, which typically causes undesirable interruptions in the field.

In exemplary embodiments, guide 200 may be constructed of a tough rigid metal or material that is nonetheless malleable enough to bend (for example with the aid of tools). This way, a user may adjust a friction to be applied to the spool hub by adjusting the angle at which the legs narrow depending on the size or width of the spool hub being used with guide 200. The next figure helps to illustrate this point.

FIG. 4(*b*) illustrates a bottom view of the wire spool guide depicted in FIG. 4(*a*), and further depicting an area representative of a spool coupled to the wire spool guide shown. This figure illustrates how the clips of each leg rest tightly at friction points 403 against a spool hub (illustrated as dotted lines). As mentioned above, a user of the device in the field may tighten or loosen the friction points by bending each leg at a desired angle.

FIG. 4(*c*) illustrates an alternative embodiment of the wire spool guide depicted in FIG. 4(*a*), in which there is no attachment point and the wire-guiding element is unitary with the anterior support to form a unitary frame 401. In such embodiments, or even in alternative embodiments in accordance with the present invention, a coating or layer may be applied of a different material that adds an additional frictional element to the wire-guiding element. For example and without limiting the scope of the present invention, the wire-guiding element my be coated with a rubber or plastic coat such that a wire guided therein may be provided with added friction.

Turning now to the last set of figures, FIG. 4(*d*) illustrates an exemplary embodiment of the wire spool guide depicted in FIG. 4(*a*), which includes a frictional element such as an etched portion or surface on an interior region of the wire-guiding element. More specifically, the wire guiding element of the embodiment in FIG. 4(*d*) may include frictional element 410, which may be etched, applied or otherwise situated on a surface of the wire guide element in order to add a frictional force that facilitates use of the device.

FIG. 4(*e*) illustrates an exemplary embodiment of the wire spool guide depicted in FIG. 4(*a*), which includes a telescoping element to adjust a length of a support structure of a frame of the wire spool guide. More specifically, an anterior support structure 401 such as a midsection of a rod or frame in accordance with the present invention is shown to include telescoping portions 411, which may slidably shorten or lengthen a length L of the anterior support of the device. This may be useful to, for example and without limiting the scope of the present invention, to adjust to varying sizes of spools in the field and or to securely attach the device to various sizes of spools.

Finally, FIG. 4(*f*) illustrates another exemplary embodiment that includes longer friction points for improved stability. More specifically, in such embodiment, legs 204*a* and 204*b* include two distinct lengths 412 and 413 such that a first length 412 tapers to narrow a distance 402 between the two legs, and a second length 413 of each leg is parallel to each other such that a longer friction point is created at the posterior end of the device. This creates a larger contact area for more friction and stability of structural angles when installing the device.

A wire guide in accordance with the present invention may be constructed from various types of materials without deviating from the scope of the present invention. For example, and without limiting the scope of the present invention, the frame may be constructed of multiple parts or a single part, and may have a round shape (like a rod), a rectangular shape (like a rectangular cylinder) or any other shape. Moreover, the frame may be made of metals, plastics or a combination thereof.

In exemplary embodiments, the wire guide is made of a strong, yet somewhat malleable metal alloy that is strong, durable, and relatively light weight. In exemplary embodiments, the frame of the wire guide, including the wire-guiding element's helical structure, comprise of a round cylindrical rod that has been shaped to form the helical structure, anterior support, legs and clips of the guide.

As may be appreciated from the disclosure above, the present invention reduces inherent tangling of spooled materials. Such materials typically include, without limitation, metallic electrical wire or ropes of insulated or non-insulated types, or other non-electrical ropes or wires. Such tangling typically occurs when spooled material is dispensed from their respective manufacturer-supplied or non-manufacturer-supplied spools, which may be mounted or installed on diverse types of spool-holding, spool-dispensing, spool-transporting, and or spool-handling equipment. Accordingly, the present invention is meant to be used with a wide variety of spools and spool equipment that is well known in the field.

An improved wire spool guide has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A wire spool guide formed of a rod having two terminal ends, comprising:

a first prong configured to receive a wire spool, the first prong defined by a first leg extending from a first end of a midsection of the rod and, a second leg extending from a second end of the midsection of the rod, the first leg and the second leg situated on a first plane;

a second prong configured to couple to a support of the wire spool, the second prong defined by the first leg and a third leg extending from a first u-shaped bend on the rod, the first leg and the third leg situated on a second plane;

a third prong configured to couple to the support of the spool, the third prong defined by the second leg and a fourth leg extending from a second u-shaped bend on the rod, the second leg and the fourth leg situated on a third plane; and a helical structure comprising unevenly spaced loops forming a cylindrical helix adapted to receive a portion of a wire from the wire spool, the cylindrical helix extending from the midsection of the rod, wherein:

the cylindrical helix includes an incongruous terminal end that slightly edges outward and away from a center space along an axis of the helical structure, the third leg terminates at a first terminal end of the rod, the fourth leg terminates at a second terminal end of the rod, and the second plane is parallel with the third plane, the second plane and the third plane intersecting the first plane.

2. The wire spool guide of claim 1, wherein the third leg of the second prong includes:

a first length extending from the first u-shaped bend towards the first leg, the first length terminating at a sharp bend; and a second length that extends from the sharp bend away from the first leg, the second length terminating at the first terminal end of the rod.

3. The wire spool guide of claim 1, wherein the fourth leg of the third prong includes:

a first length extending from the first u-shaped bend towards the second leg, the first length terminating at a sharp bend; and a second length that extends from the sharp bend away from the second leg, the second length terminating at the second terminal end of the rod.

4. The wire spool guide of claim 1, wherein the first leg and the second leg of the first prong taper towards each other.

5. The wire spool guide of claim 1, wherein the cylindrical helix comprises a coating material that increases friction.

6. The wire spool guide of claim 1, wherein the cylindrical helix comprises an etched surface that increases friction.

7. A wire spool guide, comprising:

a frame including an anterior support;

a prong defined by a first leg and a second leg extending from the anterior support, the first leg and the second leg each having a coupling means for coupling to a spool; and a wire-guiding element extending substantially from a center portion of the anterior support, the wire-guiding element comprising a cylindrical helix with unevenly spaced loops.

8. The wire spool guide of claim 7, wherein the coupling means of the first and second legs comprises a clip formed at the end of each of the first and second legs.

9. The wire spool guide of claim 7, wherein the first leg and the second leg of the prong taper towards each other.

10. The wire spool guide of claim 7, wherein the cylindrical helix comprises an incongruous terminal end that slightly edges outward and away from a center space along an axis of the helical structure.

11. The wire spool guide of claim 7, wherein the cylindrical helix comprises a coating material that increases friction.

12. The wire spool guide of claim 7, wherein the cylindrical helix comprises an etched surface that increases friction.

13. The wire spool guide of claim 7, wherein the first leg and the second leg each comprise of clips including friction points configured to rest tightly against a spool hub of the spool.

14. The wire spool guide of claim 7, wherein the first leg and the second leg each comprise of two distinct portions such that:

a first portion tapers to narrow a distance between the first leg and the second leg, and a second portion is straight so that the second portion of each of the first leg and the second leg runs parallel to each other to form a friction region at a posterior end of the wire spool guide.

15. A wire spool guide, comprising:

a first prong configured to receive a wire spool, the first prong defined by a first leg extending from a first end of a midsection of a frame, and a second leg extending from a second end of the midsection of the frame, the first leg and the second leg situated on a first plane;

a second prong configured to couple to a support of the wire spool, the second prong defined by the first leg and a third leg joined by a first u-shaped bend on the frame, the first leg and the third leg situated on a second plane;

a third prong configured to couple to the support of the wire spool, the third prong defined by the second leg and a fourth leg joined by a second u-shaped bend on the frame, the second leg and the fourth leg situated on a third plane, wherein the second plane and the third plane intersecting the first plane; and a helical structure adapted to receive a portion of a wire from the wire spool, the helical structure extending from the midsection of the frame and comprising a cylindrical helix with unevenly spaced loops.

16. The wire spool guide of claim 15, wherein the second prong and the third prong each comprise of clips including friction points configured to rest tightly against a spool hub of the wire spool.

17. The wire spool guide of claim 15, wherein the second prong and the third prong each comprise of two distinct portions such that:

a first portion tapers to narrow a distance between the second prong and the third prong, and a second portion is straight so that the second portion of each of the second and third prongs runs parallel to each other to form a friction region at a posterior end of the wire spool guide.

18. The wire spool guide of claim 15, wherein the cylindrical helix comprises an incongruous terminal end that slightly edges outward and away from a center space along an axis of the helical structure.

* * * * *